US009114427B2

(12) United States Patent
Grosso et al.

(10) Patent No.: US 9,114,427 B2
(45) Date of Patent: Aug. 25, 2015

(54) ACOUSTIC ANTENNA HAVING INTEGRATED PRINTED CIRCUITS

(75) Inventors: Gilles Grosso, Six Fours les Plages (FR); Frederic Mosca, Marseilles (FR)

(73) Assignee: IXBLUE, Marly le Roi (FR)

( * ) Notice: Subject to any disclaimer, the term of this patent is extended or adjusted under 35 U.S.C. 154(b) by 815 days.

(21) Appl. No.: 12/991,033

(22) PCT Filed: May 6, 2009

(86) PCT No.: PCT/FR2009/050842

§ 371 (c)(1),
(2), (4) Date: Nov. 4, 2010

(87) PCT Pub. No.: WO2009/141569

PCT Pub. Date: Nov. 26, 2009

(65) Prior Publication Data

US 2011/0051969 A1 Mar. 3, 2011

(30) Foreign Application Priority Data

May 7, 2008 (FR) ..... 08 02548

(51) Int. Cl.
*B06B 1/06* (2006.01)

(52) U.S. Cl.
CPC ..... *B06B 1/0629* (2013.01)

(58) Field of Classification Search
CPC .. B06B 1/0618; B06B 1/0614; B06B 1/0607; B06B 1/00; B06B 1/06; B06B 1/20; B06B 1/0629; B06B 1/0625; B06B 1/064; B06B 1/02; B06B 1/0207; H01L 41/047; H01L 41/053; H01L 41/113; H01L 41/1132; H01L 41/08; H04R 3/12; H04R 3/14; H04R 3/04
USPC ..... 381/340; 310/325, 327, 328, 329
See application file for complete search history.

(56) References Cited

U.S. PATENT DOCUMENTS

| | | | | |
|---|---|---|---|---|
| 3,370,186 | A * | 2/1968 | Antonevich | 310/325 |
| 3,739,327 | A * | 6/1973 | Massa | 367/157 |
| 4,373,143 | A | 2/1983 | Lindberg | |
| 4,545,041 | A | 10/1985 | Tims et al. | |
| 5,726,952 | A * | 3/1998 | Eckert et al. | 367/140 |
| 5,998,908 | A * | 12/1999 | Goodson | 310/325 |
| 6,181,052 | B1 | 1/2001 | Puskas | |

OTHER PUBLICATIONS

International Search Report, dated Jan. 26, 2010, from corresponding PCT application.

* cited by examiner

*Primary Examiner* — Davetta W Goins
*Assistant Examiner* — Jasmine Pritchard
(74) *Attorney, Agent, or Firm* — Young & Thompson

(57) ABSTRACT

An acoustic antenna includes an array of elementary submarine transducers, each elementary transducer including, between a counterweight and a horn, at least one ceramic. Each elementary transducer is mounted on a printed circuit so that the printed circuit is clamped between the ceramic and counterweight thereof. The printed circuit includes conductors for connection to electrodes of the respective ceramic for individual control of the elementary transducers. The weight of each element of the elementary transducer is set to minimize cross-talk between channels.

6 Claims, 4 Drawing Sheets

ACOUSTIC ANTENNA HAVING INTEGRATED PRINTED CIRCUITS

The present invention relates to an acoustic antenna with integrated printed circuits and, in particular, to a low-cost acoustic antenna.

The acoustic transduction technology traditionally used in underwater applications and offering the best compromise between radiated acoustic power and useable bandwidth is the "Tonpilz". Such system is a revolution-symmetrical electro-acoustic converter of the mass-spring-mass type that generally operates in expansion/compression mode.

Figure 1:
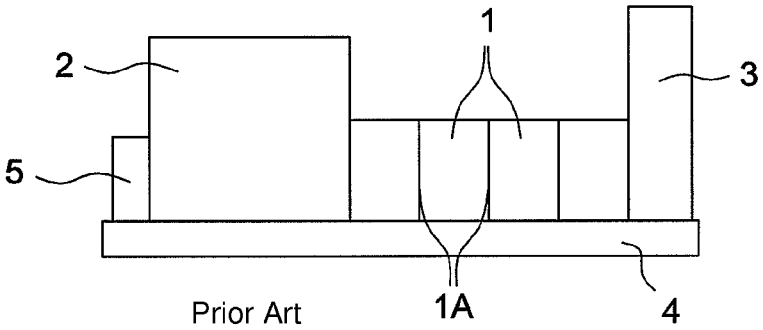

Such a Tonpilz transducer has been schematically shown in FIG. 1. It essentially comprises a stack 1 of piezoelectric (or electrostrictive) ceramic discs, clamped between a thick disc 2 acting as a counterweight and a disc 3, thinner than the disc 2, acting a horn. All these discs are provided with a central opening for the passage of a clamping rod 4 providing the clamping thereof with a nut 5.

Each of the elements shown in FIG. 1 plays a particular role: the driving function is provided by the pillar 1 of piezoelectric ceramics electrically connected to each other by electrodes 1A formed on the opposite plane faces thereof. The ceramics are wired in parallel. The horn 3 provides the acoustic coupling with the environment and also permits the bandwidth enlargement by natural mode referred to as "flexural vibration mode". It is the element that determines the radiated field (directivity pattern) geometry. The counterweight 2 stabilizes the system and channels the radiated energy into a single direction in space. The prestressing rod 4 and the clamping nut 5 ensure the operation of the device (transducer) in expansion/compression mode.

The quantity of wires to be welded is thus very quickly redhibitory for high-frequency antennas (higher than 50 kHz) composed of a great number of small-size transducers, for example, and in a non limitative way, 128 elementary transducers at 150 kHz. This wiring, welding and indexing item, which is very difficult to automate, is the heaviest item of the process of mounting an acoustic antenna.

The present invention has for object a low-cost acoustic antenna requiring the fewest possible number of assembly operations, which operations can be easily automated. The term "acoustic" is used herein for simplification, but it is well understood that the operation frequency band of the antenna can be higher than the audio frequencies and even far higher than the latter; for example, it can extend from 20 kHz up to several hundreds of kHz, and typically, but not limitatively, it may be the 140-160 kHz frequency band.

The acoustic antenna according to the invention is characterized in that it comprises an array of elementary transducers, each elementary transducer comprising, between a counterweight and a horn, at least one ceramic, all the elementary transducers being mounted on a common printed circuit for electrical connection between the transducers and for positioning the transducers relative to one another, and at least one connector fixed to this printed circuit, each of the transducers being mounted in such a way that the printed circuit is clamped between the ceramic(s) and the counterweight thereof.

According to a feature of the invention, the elementary transducers are of one of the following electro-acoustic types: piezoelectric or electrostrictive.

Figure 2:
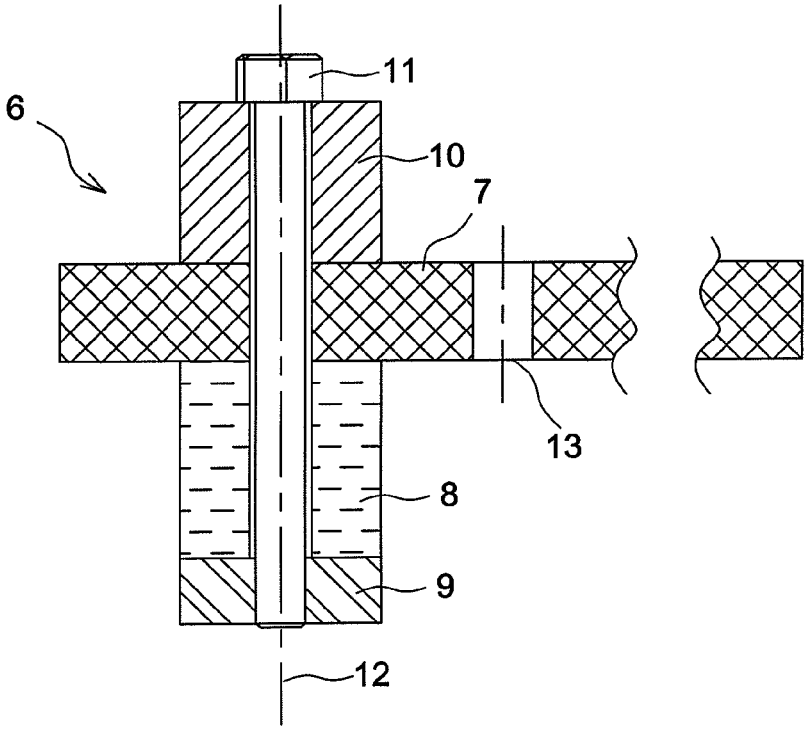
Figure 3:
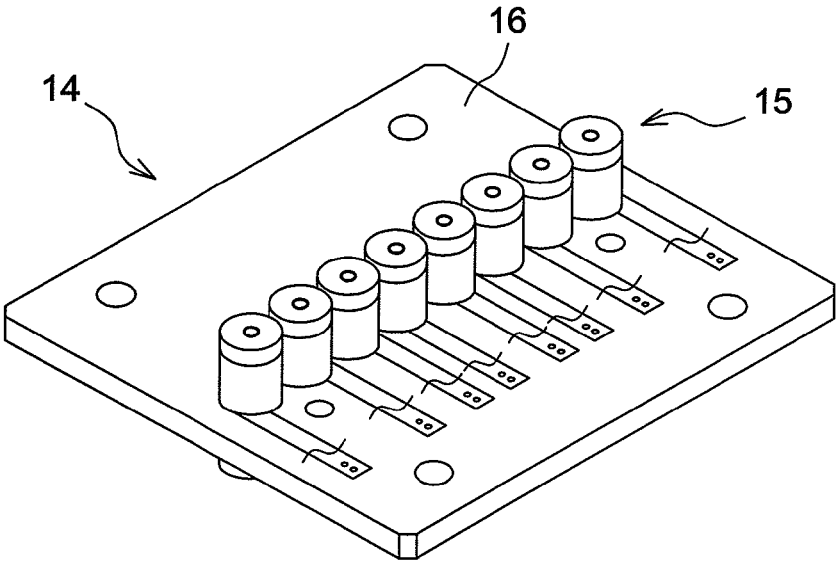
Figure 4:
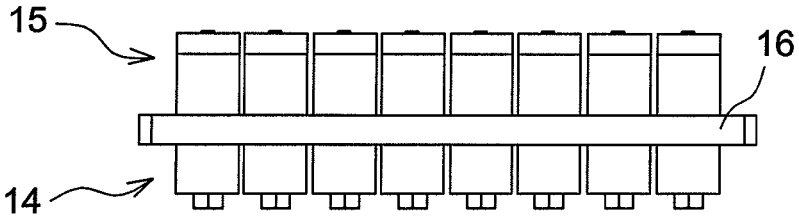
Figure 5:
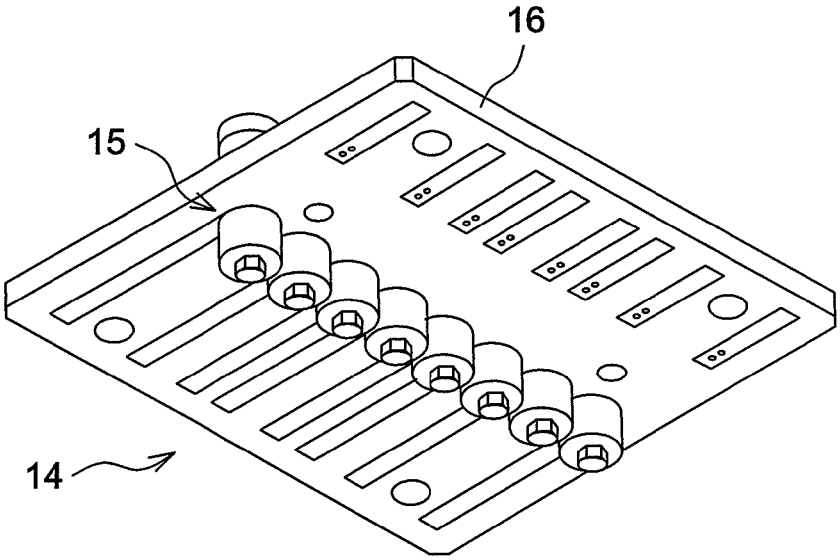
Figure 6:
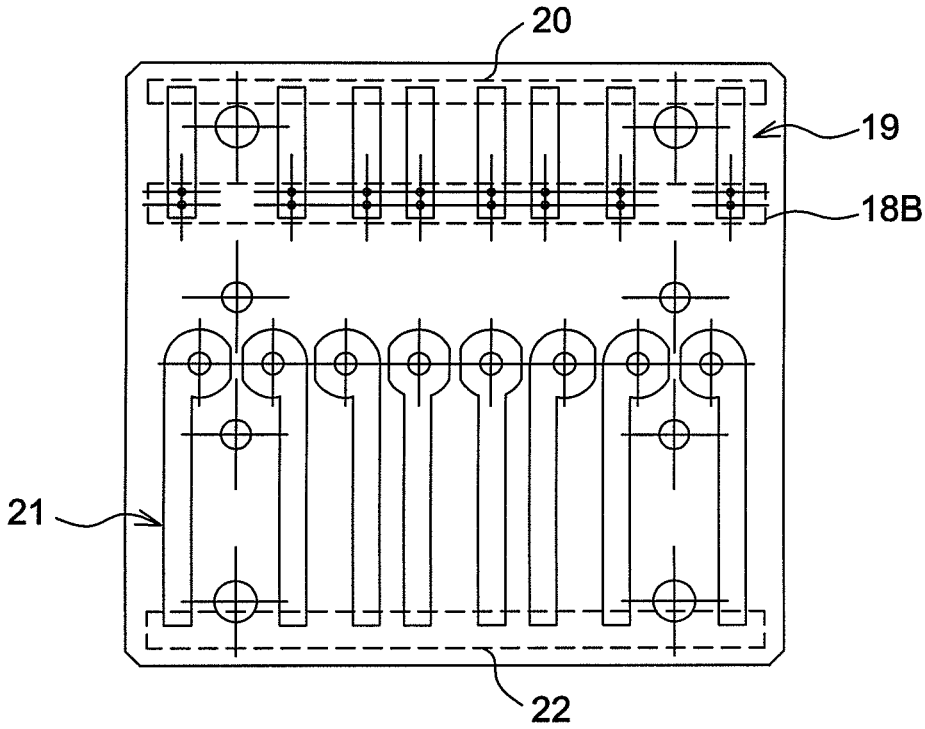
Figure 7:
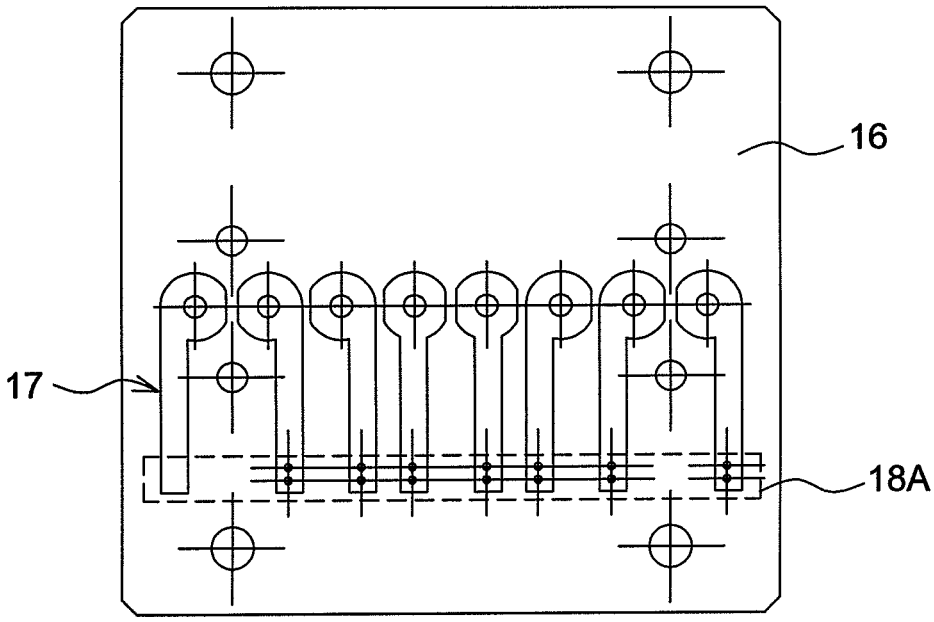
Figure 8:
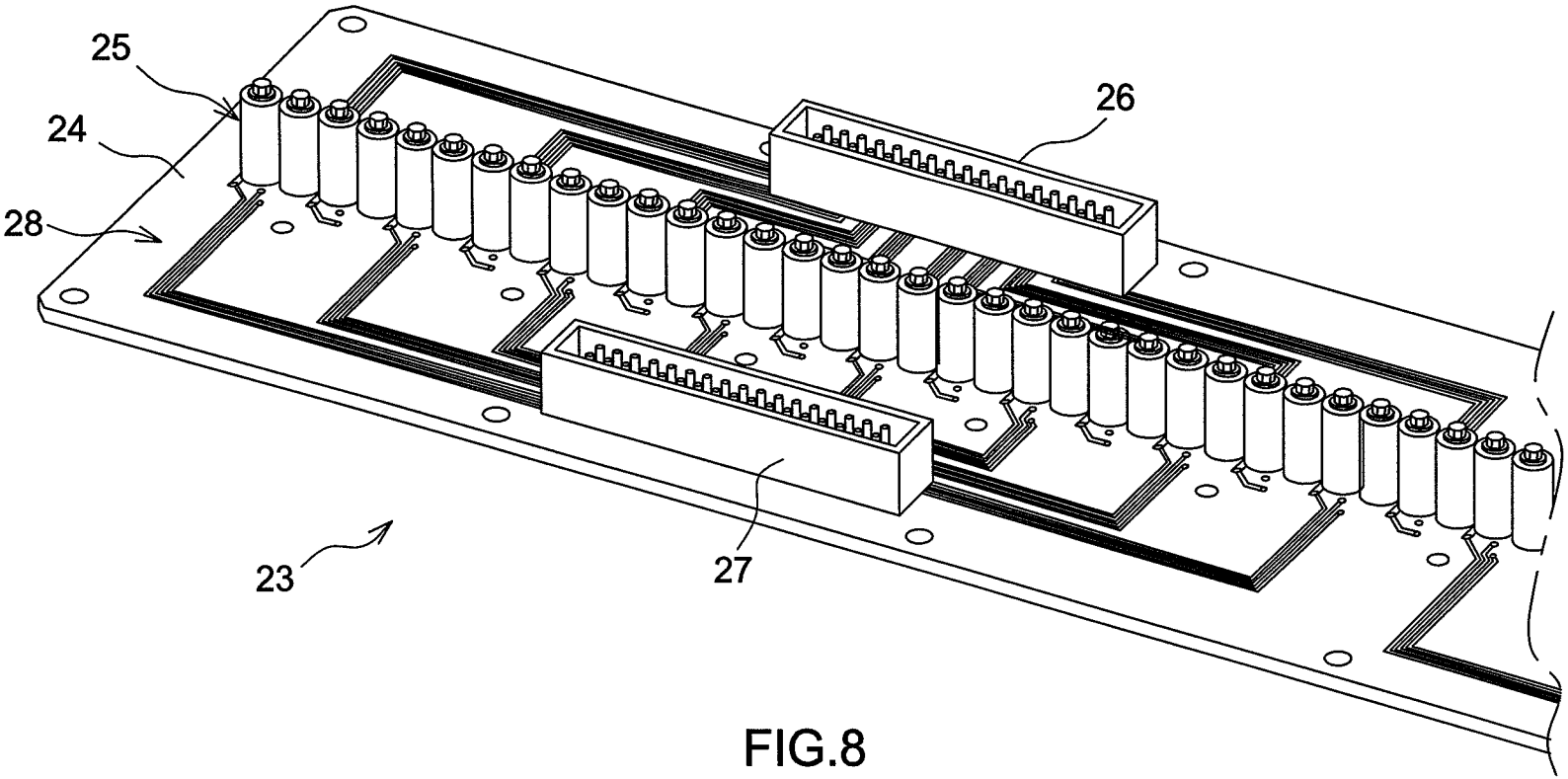

The present invention will be better understood from the description of an embodiment, which is given by way of a non-limitative example and illustrated in the appended drawing, in which:

FIG. 1, mentioned above, is a simplified sectional view of a "Tonpliz" antenna element according to the prior art, FIG. 2 is a sectional view of an elementary transducer mounted on a printed circuit, according to the invention, FIGS. 3 to 7 are, respectively, a perspective top view, a face view, a perspective bottom view, a bottom view and a top view of an embodiment, according to the present invention, of a printed circuit carrying eight elementary transducers, the tracks of the printed circuit being schematically and partially shown, and FIG. 8 is a partial perspective top view of the printed circuit and the transducers of a 64-transducers antenna according to the invention.

An object of the present invention is to eliminate, in the manufacturing process, the items of positioning the transducers on their support material and welding their connection electrodes (transducers power supply leads) from the manufacturing process of high-frequency Tonpilz antennas having a great number of elements.

According to a preferred embodiment, the invention contemplates to reduce the pillar of ceramics of the Tonpilz to only one ceramic and to fix the different pillars to a printed circuit that is common to the whole antenna in the structure of the Tonpilz, between the ceramic and the counterweight, so as to provide the electrical connection of all the elements of the antenna and to fix the arrangement of the transducers relative to one another in a stable way. It is well understood that the invention is not limited to transducers with a single ceramic, and that these transducers can comprise more than one ceramic.

In FIG. 2 is shown an elementary transducer 6 according to the invention, fixed to a printed circuit 7. According to the invention, the insulating material of the printed circuit is chosen based on the characteristics of the transducers used, for example, and in a non limitative way, this material may be epoxy glass or any screen-printable base material. The transducer 6 essentially comprises a tubular ceramic 8, a disc-shaped horn 9 and a counterweight 10. These three elements 8 to 10 are assembled in the following manner to the printed circuit 7 by means of a screw 11 passing through a bore of this printed circuit: the counterweight 10 is applied on one face of the printed circuit, whereas the ceramic 8 is applied on the other face of this circuit, and the horn 9 is applied on the free plane face of the ceramic 8. Hence, the screw 11 (assembly and prestressing screw) passes freely through the elements 10, 7 and 8, and is screwed into a threaded axial bore of the horn 9. The common axis of all these elements is referenced 12. Of course, a great number (a hundred or more) of other transducers can be fixed to the printed circuit 7 and, by way of example, a bore 13 formed in this printed circuit for fixing a transducer next to the transducer 6 has been shown. The layout topology of the different transducers on the printed circuit 7 is determined in a manner known per se in order to obtain a desired radiation pattern and, if need be, so that a beam forming and directing system can be implemented.

The electrical connections are provided as follows. The printed circuit 7 receives each of the positive and negative points of the transducer on its two main faces. The positive connection is obtained by direct contact of one plane face of the ceramic with the printed circuit 7. The negative connection is indirectly obtained: the other plane face of the ceramic is in direct contact with the horn (electrically conductive), and the screw 11 electrically connects the horn to the counterweight, and the counterweight is in direct contact with the printed circuit 7. The screw 11 is electrically insulated from the ceramic by means of a sleeve (not shown), made for example of a plastic material.

The topography of the conductors formed on the printed circuit 7 and running from the transducers is optimized, and these conductors are connected to a connector (not shown) fixed to the printed circuit. These conductors convey the excitation energy of the transmission channels from the power and control electronic devices (not shown) and, in receiving phase, they convey the signals toward the processing electronic circuits (not shown).

To simplify the drawing, an embodiment of an antenna 14 (without a protective casing) according to the invention has been shown in FIGS. 3 to 7 with only eight transducers, referenced 15 as a whole, but it is well understood that, in reality, an antenna generally comprises a greater number of transducers, for example at least 64. These transducers 15 have been shown aligned relative to one another, but it is also well understood that, in reality, they are not necessarily aligned relative to one another, and that their arrangement on the printed circuit carrying them is based, in a manner known per se, on the characteristics of the acoustic beam to be obtained.

The transducers 15 are fixed to a plate 16 on which are printed conductors for electrical connection between the different transducers and a connector (not shown) providing, with another connector (not shown either), the connection with suitable signal receiving and processing circuits, well known per se and not described herein.

The conductors 17 printed on the upper face of the plate 16 (the one against which are applied the ceramics such as the ceramic 8 of FIG. 2) each comprise a circular part surrounding the fixation bore of the transducer, providing the contact with a first front electrode of the corresponding ceramic, and being continued by a threadlike part running up to an area 18A in which these conductors 17 are connected, through the plate 16, in an area 18B (opposite the area 18A) of the lower face of the plate 16, to sections of conductors 19, the ends of which are welded to a connector (not shown, only the mark 20 of which on the plate 16 is shown). Conductors 21 are printed on the lower face of the plate 16. They provide the electrical connection with a second electrode of each ceramic, and have a shape similar to that of the conductors 17, with that difference that their ends are welded to a second connector (not shown, only the mark 22 of which on the plate 16 is shown). Of course, the conductors printed on the plate 16 can have other routes and be connected in a different manner to the connector(s).

The antenna 23 shown in FIG. 8 essentially comprises a plate 24 with printed circuits, on which are fixed 64 transducers referenced 25 as a whole. Four connectors (only two of which, referenced 26, 27, are visible in the figure) are fixed to the plate 24. The plate 24 with printed circuits is of the dual-face type and, therefore, in the figure, only the tracks 28 printed on a single one of the faces thereof are seen. The whole is fixed within a sealed casing (not shown). Likewise, the electronic circuits (pre-amplification, amplification, preprocessing . . . ) that can be included in this casing are not shown either.

The advantages of the present invention are of five orders:

1. Ease of mounting of the stacking/clamping-type Tonpilz.

2. Very precise mutual positioning of the transducers by nature (determined by the printed circuit), which ensures a good repeatability of the radiation characteristics of the antenna so formed.

3. Elimination of the performance dispersion due to the welding (thermal deformation, drift of the assembled parts characteristics), on small transducers.

4. Automatic indexing of the transducers wiring by the printed circuit.

5. The electro-acoustic control of the antenna (individual control of each transducer) becomes automatable. Indeed, the connector(s) can also be connected to a test circuit arranged in the antenna casing and remotely controlled to directly perform the appropriate tests in situ.

6. All the above-mentioned advantages lead to a reduction of the cost of production, because they permit a considerable time saving.

The vibratory couplings between channels ("cross-talking") liable to appear through the printed circuit are minimized thanks to optimisation of the operation by the finite element method, by optimizing the weight of each element of each transducer, in particular the counterweights (10), so as to bring back the nodal point of vibration of the structure at the printed circuit so as to reduce the most possible the deformation of the latter and the potential minute displacements of the transducers on their support plate (generally, the rod for fixing the transducers on the printed circuit plate is far more elastic than the ceramic, and the prestress it exerts on the transducer is not sufficient to clamp it but is sufficient to ensures the electrical contact between the elements of the transducers and the printed circuit). To implement the optimisation of the transducers, the structure of each transducer is shown as a lattice of small volume elements, in which each of the acoustic magnitudes is calculated, knowing the initial conditions and the boundary conditions and by applying the Kirchhoff theorem.

The invention claimed is:

1. An easy-mounting acoustic antenna, comprising:

an array of at least 64 elementary transducers (15), each of the elementary transducers comprising, between a counterweight (10) and a horn (9), at least one ceramic (8), all the elementary transducers being mounted on a common printed circuit board (7, 16) for electrical connection of each of said elementary transducers, and for positioning the elementary transducers relative to one another, said printed circuit board comprising a plate of dual-face type and conductors formed on opposite faces of said plate, said conductors conveying excitation energy of transmission channels from power and control electronic devices and, in a receiving phase, said conductors conveying signals toward processing electronic circuits, and at least one connector (26, 27) fixed to said printed circuit board and providing with another connector connection with suitable receiving and processing circuits, wherein each of the elementary transducers is mounted in such a way that the printed circuit board is clamped between the ceramic(s) and the counterweight thereof, wherein a weight of each element of each said elementary transducer is optimized so as to minimize vibratory couplings or cross-talk between channels appearing through the printed circuit of the acoustic antenna.

2. The antenna according to claim 1, wherein the elementary transducers are piezoelectric or electrostrictive electro-acoustic transducers.

3. The antenna according to claim 1, wherein the elementary transducers are aligned relative to one another.

4. The antenna according to claim 1, wherein the elementary transducers are not aligned relative to one another, their arrangement on the printed circuit board carrying them being based on the characteristics of the acoustic beam to be obtained.

5. The antenna according to claim 2, wherein the elementary transducers are aligned relative to one another.

6. The antenna according to claim 2, wherein the elementary transducers are not aligned relative to one another, their arrangement on the printed circuit board carrying them being based on the characteristics of the acoustic beam to be obtained.

* * * * *